US010760227B2

(12) United States Patent
Chapple et al.

(10) Patent No.: US 10,760,227 B2
(45) Date of Patent: Sep. 1, 2020

(54) FLOTATION MACHINE HAVING PAN SUPPORT STRUCTURE CONFIGURED FOR CONFORMING THE SHAPE OF A FLOAT PAN

(71) Applicant: Multiquip, Inc., Cypress, CA (US)

(72) Inventors: Larry Jake Chapple, Boise, ID (US); Benjamin Eric Ward, Eagle, ID (US)

(73) Assignee: MULTIQUIP INC., Cypress, CA (US)

( * ) Notice: Subject to any disclaimer, the term of this patent is extended or adjusted under 35 U.S.C. 154(b) by 0 days.

(21) Appl. No.: 16/254,451

(22) Filed: Jan. 22, 2019

(65) Prior Publication Data

US 2020/0232169 A1 Jul. 23, 2020

(51) Int. Cl.
*E01C 19/42* (2006.01)
*E01C 19/40* (2006.01)

(52) U.S. Cl.
CPC ..... *E01C 19/42* (2013.01); *E01C 19/405* (2013.01)

(58) Field of Classification Search
CPC ..... E01C 19/22; E01C 19/42; E01C 19/44
USPC ..... 404/112
See application file for complete search history.

(56) References Cited

U.S. PATENT DOCUMENTS 2,605,683 A * 8/1952 Boulton ..... E04F 21/248 404/112
2,667,824 A * 2/1954 McCrery ..... E04F 21/161 404/112
5,061,115 A 10/1991 Godbersen et al.
5,882,249 A 3/1999 Ferland
6,066,034 A 5/2000 Hettes et al.
6,200,065 B1 3/2001 Eitzen
6,695,532 B2 2/2004 Somero et al.
6,857,815 B2 2/2005 Allen et al.
6,860,675 B2 3/2005 Rose
7,048,620 B1 5/2006 Riley et al.
7,059,801 B2 6/2006 Snyder et al.
7,104,725 B1 9/2006 Kipp et al.
7,108,451 B2 9/2006 Ewer et al.
7,114,876 B1 10/2006 Allen et al.
7,144,194 B2 12/2006 Kipp, Jr.
(Continued)

OTHER PUBLICATIONS

Allen Engineering Corp. COMPODISK. http://www.concreteconstruction.net/products/general-construction-equipment/allen-engineering-corp-compodisk_o. Aug. 30, 2018.
(Continued)

*Primary Examiner* — Gary S Hartmann
(74) *Attorney, Agent, or Firm* — Burdick Patents, P.A.; Sean D. Burdick

(57) ABSTRACT

A support structure for a float pan for floating a concrete surface provides an interface between the float pan and a rotating machine. The support structure is characterized by a hub configured for concentric attachment to a rotor, and by trusses that extend radially from the hub, each providing a float pan contact surface and means for attachment to the float pan. Perimetric bracing links the trusses about the perimeter of the support structure. A machine similar to a walk-behind or ride-on trowel but without rotor blades, may incorporate the support structure and operate as a dedicated power flotation machine. Under weight of the machine, the contact surfaces of the trusses conform the float pan to a desired shape or radius of curvature for optimizing a flotation process.

17 Claims, 10 Drawing Sheets

(56) References Cited

U.S. PATENT DOCUMENTS

| | | | | |
|---|---|---|---|---|
| 7,207,745 | B2 * | 4/2007 | Goossens | E04F 21/248 404/112 |
| 7,316,523 | B1 | 1/2008 | Allen et al. | |
| 7,530,762 | B2 | 5/2009 | Reed et al. | |
| 7,674,069 | B2 | 3/2010 | Stenzel | |
| 7,775,741 | B2 | 8/2010 | Copoulos | |
| 7,891,906 | B2 | 2/2011 | Quenzi et al. | |
| 9,046,138 | B2 | 6/2015 | Kienzle et al. | |
| 9,631,378 | B1 | 4/2017 | Grahl et al. | |
| 9,790,693 | B2 | 10/2017 | Wilde | |
| 10,011,999 | B2 | 7/2018 | Tchakarov et al. | |
| 2004/0018052 | A1 * | 1/2004 | Dhont | E04F 21/245 404/112 |
| 2008/0101861 | A1 * | 5/2008 | Beard | E04F 21/248 404/112 |

OTHER PUBLICATIONS

Pans and Blades—Steel Float Pans. https://alleneng.com/concrete-equipment/finishing/trowel-pans-blades. Aug. 30, 2018.

Equipment Data Sheet—Blades & Floats https://www.parchem.com.au/public/pdfs/equipment/Blades-and-Floats---Power-Trowels.pdf. Aug. 30, 2018.

Power Trowel Pans https://www.whitecap.com/shop/wc/power-trowel-pans#facet:&productBeginIndex:0&orderBy:&pageView:grid&minPrice:&maxPrice:&pageSize:&. Aug. 30, 2018.

Z Clip Power Trowel Pans https://marshalltown.com/concrete-powertrowelpans-zclippowertrowelpans. Aug. 30, 2018.

* cited by examiner

SECTION A-A

SECTION B-B

FLOTATION MACHINE HAVING PAN SUPPORT STRUCTURE CONFIGURED FOR CONFORMING THE SHAPE OF A FLOAT PAN

BACKGROUND OF THE INVENTION

Field of the Invention

The present invention relates generally to power floats or flotation machines for smoothing and compacting poured concrete prior to finishing. More specifically, the invention relates to a flotation machine having a support structure dedicated to interface with a float pan.

Description of Related Art

Floating is a well-known construction technique used during the process of finishing a newly poured concrete surface. Floating describes the act of passing a flat tool over and downward against a leveled slab of concrete to remove surface imperfections, flatten the surface, and compact the concrete to sink the aggregate and bring water to the surface.

Float tools, or floats, may be designed for manual or power operation. Manual floats are typically used on concrete pours over relatively small areas, such as in residential construction. A manual float typically includes a rectangular surface made of wood, or of metal such as aluminum, magnesium, or steel. Power floats are used for larger pours. A power float is a device powered by an engine or motor that rotates float blades or a float pan. Float blades and float pans are typically made of abrasion-resistant steel. The weight of the power trowel itself provides the downward force necessary to achieve the desired floating effect. One type of power float is a walk-behind power trowel fitted with float blades or combination (float and finishing) blades. Another type of power float is achieved by fitting a ride-on trowel with a float pan accessory that attaches underneath the finishing blades of each trowel, so that the float pans support the trowel and operator above the surface of the concrete while rotating to both smooth the concrete and propel the trowel along its surface.

When using a ride-on trowel as a flotation machine, certain difficulties can arise from retro-fitting a power trowel to function as a power float. The rotor blades of a power trowel are designed primarily for finishing a concrete surface—not for supporting a float pan—and thus the rotor blades provide an imperfect interface. As a result, the float pan can be difficult to center when fitting it to the rotor blades, and if installed off-center, can cause undesirable movement of the trowel or pan during operation. Even when the float pan is properly centered, the ride-on trowel, which can weigh in excess of 2500 lbs, when pressing rotor blades against the float pan can form nonplanar areas on the float pan that cause grooves or furrows in the concrete surface. These must be smoothed over by additional passage of the float pan, or by another power float. Repeated use of a poorly fit float pan can also reduce its the useful life.

What is needed is an advancement in power float design, dedicated to perfecting the floating process itself, that preserves a desired shape of a float plan during power operation.

SUMMARY OF THE INVENTION

The present invention provides an engineered solution for overcoming the aforesaid problems in prior power flotation machines. According to the invention, an advanced power flotation machine provides a specialized pan support structure as a direct mechanical interface between the rotor and the float pan. Such a machine can be operated exclusively as a flotation machine, without intermediate attachment of the float pan to trowel blades. Advantageously, the specialized pan support structure when under load conforms the shape of the float pan to an optimal, desired shape during concrete floating operations.

In one embodiment of the invention, a support structure for a float pan includes a hub having a rotational axis and configured for concentric attachment to a rotor. A plurality of trusses extend radially from the hub, each truss having a float pan contact surface, and one or more of the trusses includes a means for attachment to the float pan. The support structure is further strengthened by perimetric bracing that links two or more of the trusses, and preferably all of the trusses.

The hub of the support structure may further incorporate a flange positioned concentrically with respect to the rotational axis, and a truss attachment surface displaced radially from the axis along a perimeter of the flange. The flange in one embodiment forms a planar surface normal to the axis, and the truss attachment surface extends perpendicularly from the planar surface of the flange to provide sufficient area, for attaching the trusses at their proximal ends. In another embodiment, the truss attachment surface is cylindrical in form and entirely encloses the flange. In a more elaborate embodiment, the hub may define a centering hole configured to receive a centering bracket mounted on a float pan, so that the centering hole while receiving the centering bracket will urge the float pan into concentric alignment with the support structure.

In another embodiment, the support structure includes one or more trusses that each consist of a pair of truss arms. In this arrangement, the pair of truss arms may be connected together at a distal end of the truss that is formed by the truss arm pair. Preferably, the plurality of trusses, or truss arm pairs, are angularly spaced about the axis of the hub at regular intervals. An exemplary embodiment of the invention includes eight trusses, each angularly spaced from an adjacent truss by 45 degrees.

According to the invention, to conform the shape of a float pan under load, the float pan contact surface of each truss may have a form identical to the float pan contact surface of every other truss. Various forms of float pan contact surfaces are possible. The float pan contact surface may be substantially fully flat. The float pan contact surface may be substantially fully curved in a radial direction. The float pan contact surface may be partially flat in a radial direction and partially curved in the radial direction. When fully or partially curved, the curve of a float pan contact surface may conform to a desired radius of curvature. In any one of the foregoing examples, the float pan contact surface of one or more of the trusses may, at its proximal end, be recessed from the float pan contact surface in an axial direction. one or more of the trusses may also include, at its distal end, a notch configured for engaging the perimetric bracing.

Another embodiment of the invention provides a machine for floating a concrete surface. The machine includes a rigid frame adapted to be disposed over the concrete surface, means attached to the rigid frame for providing motive power to the machine, a rotatable rotor assembly attached to the rigid frame and configured for converting the motive power into rotational motion, and a float pan support structure. The float pan support structure is rotatably coupled to the rotor assembly and configured for rotatable attachment to a float pan. The float pan has a conformable shape configured to frictionally contact the concrete surface and support the rigid frame thereabove, and the support structure is configured for conforming the shape of the float pan. The float pan support structure may further include a specialized hub. The hub has a rotational axis and is configured for concentric attachment to the rotor assembly. A plurality of trusses extends radially from the hub, each truss has a float pan contact surface, and one or more of the trusses includes means for attachment to the float pan. Perimetric bracing links two or more of the trusses, and preferably all of the trusses. According to the invention, the support structure may be configured to conform the conformable shape of the float pan to any of various shapes, such as substantially fully flat, substantially fully curved in a radial direction, and partially flat in the radial direction and partially curved in the radial direction.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

FIG. 11 is magnified side view of the distal end of the truss arm of FIG. 10 at detail D.

DETAILED DESCRIPTION OF THE INVENTION

The present invention discloses an innovation for power flotation machine. A power flotation machine according to the invention provides a specialized pan support structure as a direct mechanical interface between rotor and float pan. Such a machine can be operated exclusively as a flotation machine, without intermediate attachment of the float pan to trowel blades. Advantageously, the specialized pan support structure when under load conforms the shape of the float pan to an optimal, desired shape during concrete floating operations. The invention may be applied to both walk-behind and ride-on machines. For purposes of illustration only, the invention is described herein in the context of a ride-on embodiment.

Figure 1:
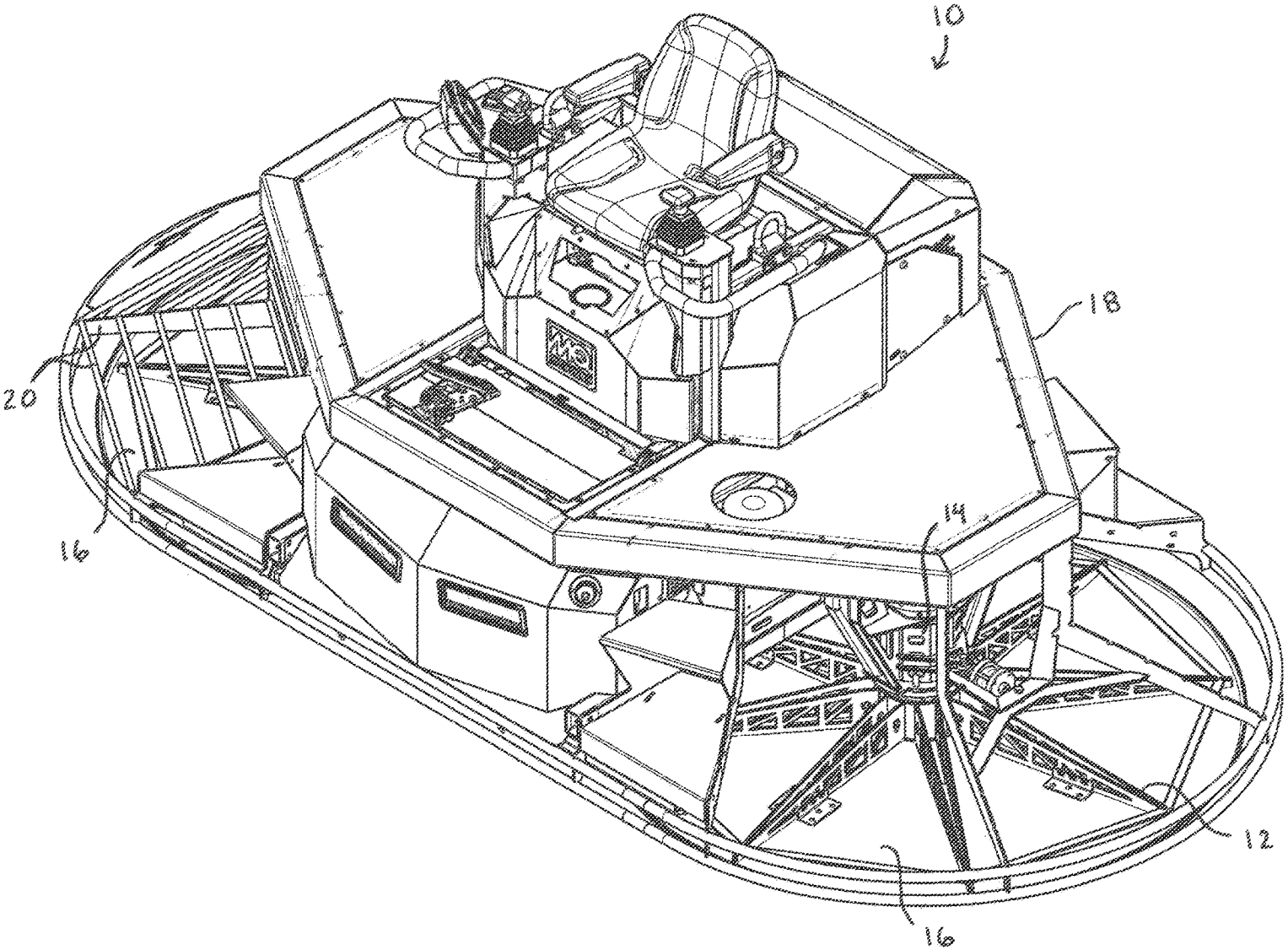
FIG. 1 is a perspective view of one embodiment according to the invention of a flotation machine having pan support structure attaching float pans to dual rotors.

FIG. 1 shows a perspective view of one embodiment according to the invention of a flotation machine 10. Flotation machine 10 is a ride-on machine that, generally speaking, operates similarly to a ride-on power trowel. The form and operation of ride-on power trowels are well known in the art, and therefore will not be discussed herein in further detail. Additional context relevant to the present disclosure may be found in co-pending U.S. patent application Ser. No. 16/006,787 filed Jun. 12, 2018, which is fully incorporated herein by reference. The present invention differs from known ride-on power trowels primarily in that, in place of rotor blades, a specialized pan support structure 12 is coupled to each of the rotor assemblies 14 (hereafter rotors 14) of the machine 10, to provide an interface for attaching float pans 16 to each rotor 14. According to the invention, the pan support structure 12 conforms the shape of a float pan 16 to a desired shape, such as one of the shapes disclosed in further detail below.

Machine 10 is designed for floating a concrete surface. Machine 10 includes a rigid frame 18 that is adapted to be disposed over a planar concrete surface, and that provides structural support for all components of the machine. Machine 10 includes means attached to the rigid frame 18 for providing motive power to said machine, such as an internal combustion engine, an electric motor, a battery, hydraulic drives, or any combination of the foregoing. Machine 10 also includes at least one but preferably two rotatable rotors 14 that are each attached to the rigid frame 18 and configured for converting the motive power into rotational motion. Machine 10 may include a protective cagework 20 that is attached to the rigid frame 18 and disposed over and about a portion of each pan support structure 12. For illustrative purposes only, cagework 20 is omitted from FIG. 1 on the right-hand side of the figure to reveal the location and form of pan support structure 12, rotor 14, and float pan 16. An inventive feature of machine 10 is the float pan support structure 12.

Figure 2:
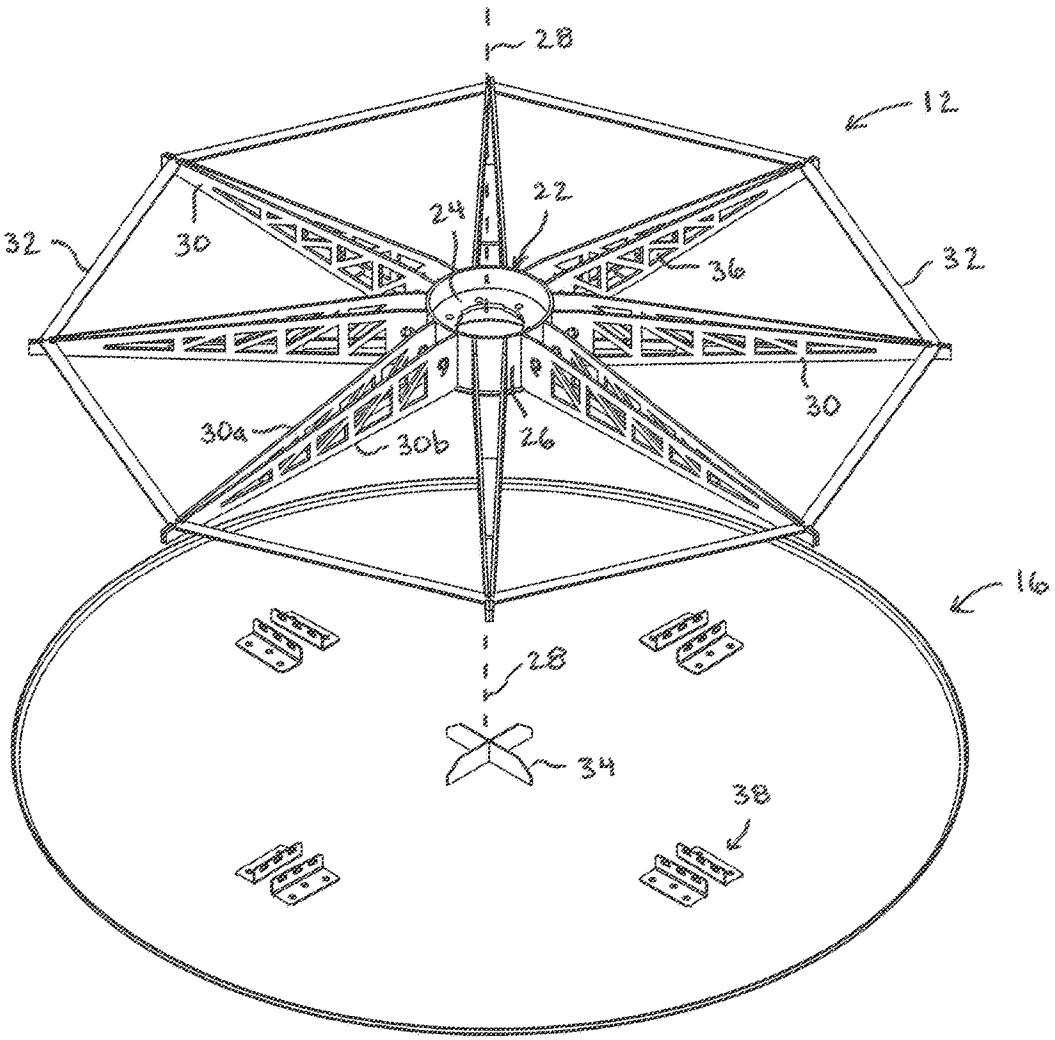
FIG. 2 is an exploded view of a pan support structure and float pan of FIG. 1.

FIG. 2 shows an exploded view that shows a float pan support structure 12 and a float pan 16. Float pan support structure 12 is a rigid structure, preferably composed of a metal such as carbon steel. Float pan support structure 12 is rotatably coupled to a rotor 14 by means of hub 22. In the embodiment shown herein, the hub 22 is formed as a circular flange 24 that is enclosed by, or bordered along its perimeter, by a cylindrical truss attachment surface 26. Whatever its shape, whether cylindrical, hexagonal, or otherwise, truss attachment surface 26 defines an imaginary axis 28 that passes linearly through its center. Accordingly, hub 22 is preferably positioned concentrically with respect to the axis 28, and as shown in the figure truss attachment surface 28 is displaced radially from the axis 28. The flange 24 preferably comprises a planar surface normal to axis 28. In one embodiment, truss attachment surface 28 may extend perpendicularly from the planar surface of flange 24, and in alternative embodiments it may extend above, or below, or both above and below the planar surface of the flange. In another embodiment, hub 22 may comprise a single cylindrical block. In any embodiment, the truss attachment surface 26 of hub 22 provides area sufficient for anchoring proximal. ends of each of a plurality of trusses 30 that extend radially from the hub.

The number of trusses 30 that compose the plurality can vary. In the embodiment disclosed herein, a total of eight trusses 30 are shown as an example. The trusses 30 are shown angularly spaced about the axis 28 of the hub 22 at regular intervals, i.e. each truss 30 is angularly offset from adjacent truss 30 by 45 degrees. Where the trusses 30 are spaced at regular intervals, the angular offset will be a function of the total number of trusses. In other embodiments, it is contemplated that trusses 30 may be spaced at irregular intervals, or at a combination of regular and irregular intervals. For example, an alternative embodiment of a float pan support structure 12 may have a total of six trusses 30, with a first set of three trusses on one half of the support structure and a second set of three trusses on the other half of the support structure, directly opposite the first set of three trusses, wherein the middle truss of each set is spaced from its two adjacent trusses by alpha degrees and from the one opposite middle truss by 180 degrees. Each of the other two trusses in a set is spaced from its two adjacent trusses by alpha degrees and by (180−2*alpha) degrees. Skilled artisans will recognize that there are many different configurations, using different spacing angles and different numbers of trusses, for angular spacing plural trusses 30 about the axis 28 of the hub 22 without departing from the scope of the invention. It is also possible to replace the plural trusses with a singular support, in circular, conical, or spherical form, that spans from hub 22 to the perimeter of the support structure 12; however such as design has the disadvantage of adding excessive weight to the assembly and adding unnecessarily to manufacturing costs.

Referring again to FIG. 2, the proximal end of each truss 30 is attached to the truss attachment surface 26, e.g. by welding or by conventional fasteners. The distal end of each truss 30, i.e. the end that meets the perimeter of the support structure 12, may be attached to the distal end of adjacent trusses 30 by a perimetric bracing 32. The perimetric bracing 32 may also be referred to herein as one or more perimetric braces 32. Each perimetric brace 32 is preferably composed of the same material (e.g. carbon steel) as other components of the float pan support structure 12. In the embodiment shown, a perimetric brace 32 is provided between each pair of adjacent trusses 30, i.e. one brace 32 per truss 30, for uniform distribution of material strength. Other embodiments are possible where there e fewer braces 32 than trusses 30, such that distal ends of one or more adjacent pairs of trusses 30 remain unlinked. Each truss 30 may be configured with a slot or other mean attachment means for attaching to perimetric bracing 30. In one embodiment, perimetric bracing 30 may be attached to the distal end of a truss 30 by welding.

In another embodiment of the invention, more of the trusses 30 may each comprise a pair of truss arms, 30*a* and 30*b*, as shown in the figures. Each pair of truss arms 30*a*-30*b* may be identical in form, but if not identical are preferably similar in form. For any pair of truss arms 30*a*-30*b*, at the proximal end each truss arm of the pair may be angularly spaced from the other truss arm of the pair, while their distal ends be attached together, so that each pair of truss arms 30*a*-30*b* forms a triangular wedge. Where the distal ends come together, the truss arms 30*a*-30*b* may be welded together or attached by other means such as conventional fasteners.

Whether a truss 30 consists of a singular arm, or a pair of truss arms 30*a*-30*b*, the lower surface of the truss 30 provides a pan contact surface 45 that when pressed against a float pan 16, conforms the upper surface of the float pan 16 to the shape of the pan contact surface 45. This will be described in further detail below with reference to FIGS. 8-14.

The float pan support structure 12, comprising hub 22, trusses 30, and perimetric bracing 32, is configured for rotatable attachment to the float pan 16. Rotatable attachment means that support structure 12 is attachable to the float pan 16 so that when a rotor 12 of machine 10 rotates, the rotational power will be transmitted by the support structure to the float pan and cause the float pan to rotate cooperatively with the rotor. Preferably, the rotatable attachment of the support structure 12 to the float pan 16 enables both components to rotate at the same frequency and without slippage. In this respect, float pan support structure provides a cooperative connection interface between each float pan 16 and each rotor 12. During operation, the weight of machine 10, which can be in excess of 2500 lbs, presses the float pan 16 downward onto a concrete surface while rotating the float pan. The float pan 16 is formed from material such as aluminum, magnesium, or soft steel, into a conformable shape configured to frictionally contact the concrete surface and support the frame of machine 10 above the concrete surface. According to the invention, the float pan support structure 12 is configured for conforming the shape of the float pan 16 into a desired shape for optimizing a concrete floating process under these conditions.

In the exploded view of FIG. 2, float pan 16 is shown beneath support structure 12 and in axial alignment therewith. The imaginary axis of rotation 28 passes through the center of hub 22 and also through the center of float pan 16, coincident with the intersection of an X-shaped alignment bracket 34. The axial alignment of the support structure 12 and float pan 16 is the desired configuration of the two components when they are in rotatable attachment during operation of machine 10. When installing float pan 16 to support structure 12, alignment bracket 34 cooperates with the inner wall of truss attachment surface 26 of hub 22 to "center" the two components by urging the float pan 16 into axial alignment with the support structure 12. Distal ends of the alignment bracket 34 may be curved or slanted, as shown, to aid in the alignment process. In one embodiment, each leg of alignment bracket 34 may have a length of about 8.6 in. and a height between about 1.0 and 2.0 in.

When the float pan 16 is axially aligned with the support structure 12, the two components may be rotatably attached. Means for effecting such rotatable attachment may include one or more of a hole 36 defined through a truss 30, the truss itself, a pair of connecting brackets 38, and a fastener (not shown) such as a hex-head bolt and nut, or a cotter pin. For example, the rotatable attachment may be achieved by angularly aligning the support structure 12 and float pan 16 so that when engaged, two or more trusses 30 abut the surface of the float pan between a pair of connecting brackets 38. In one embodiment, spacing between any two brackets of a pair of connecting brackets 38 may be about 1.7 in., and there may be multiple pairs of connecting brackets, preferably angularly spaced to receive trusses 30. For example, each pair may be angularly spaced from an adjacent pair by about 90 degrees, as shown. Fasteners may be run through bolt holes in brackets 38 and through one or more holes 36 in a truss 30 to lock the float pan to the support structure. According to the invention, such rotatable attachment may allow a minor amount of shifting to occur between the support structure and float pan in the horizontal plane, so long as the float pan is attached in such a way to substantially maintain its cooperative alignment and rotation with the support structure.

In a more elegant embodiment of the invention, a support structure for a float pan may comprise a hub that is configured for concentric attachment directly to a rotor, and a means for attaching the hub directly to the float pan. Direct attachment between the hub and a rotor means that surfaces of the two attached components abut one another. In one implementation, structure for the directly attaching means may comprise hardware such as brackets and fasteners attached to both the hub and the float pan that when fastened cause the direct attachment. In another implementation, the directly attaching means may comprise a magnetic force, provided by electromagnetic induction or by a permanent magnet. The permanent magnet may be formed as an integral part of the hub, or the entire hub may be magnetized. In any of the foregoing embodiments for direct attachment between hub and float pan, the directly attaching means may be configured for concentrically aligning the float pan to the hub.

Figure 3:
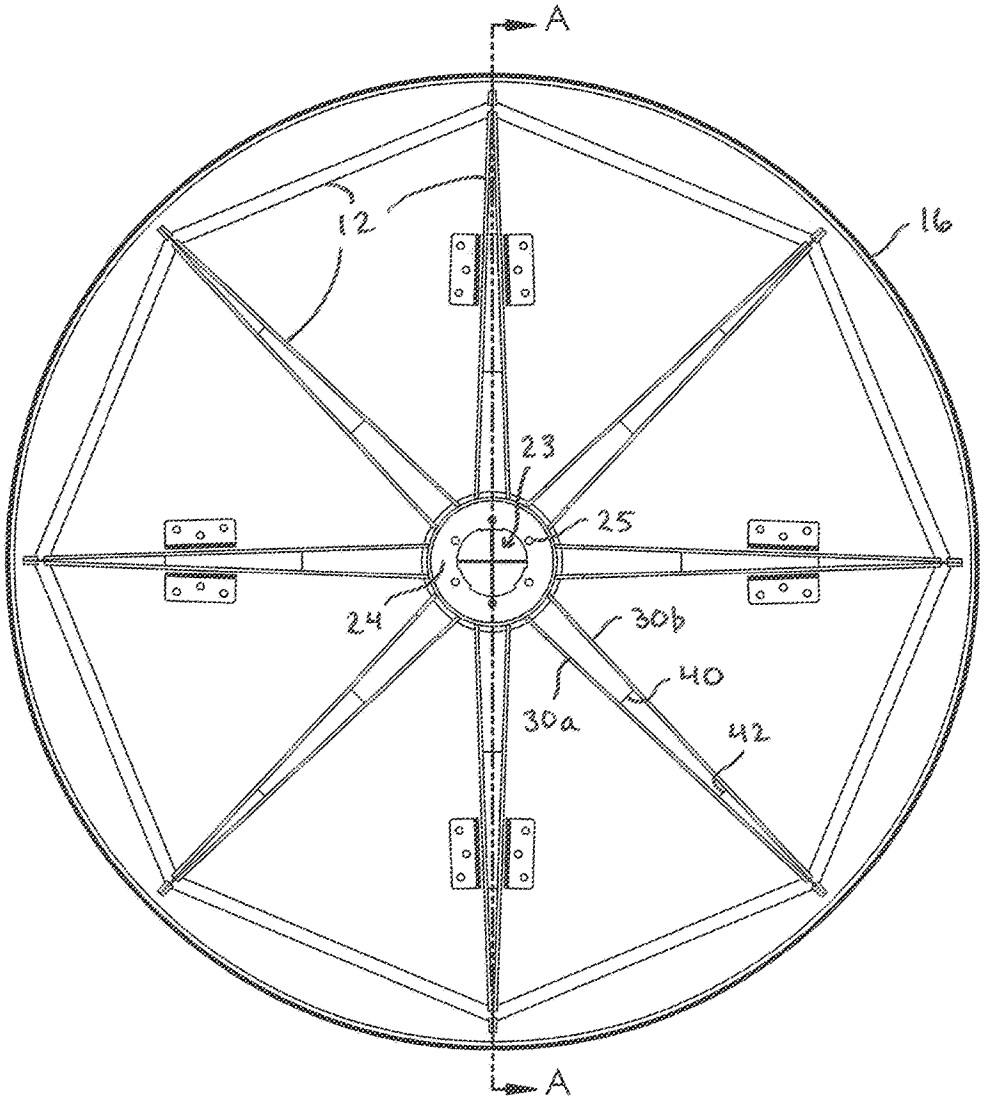
FIG. 3 is a top view of the pan support structure and float pan of FIG. 1.

FIG. 3 shows a top view of the pan support structure 12 and float pan 16 rotatably attached as described in the preceding paragraph. For illustrative purposes only, to put the overall form of the invention into proper scale, some exemplary dimensions are disclosed. A float pan 16 in one embodiment may have an overall diameter on the order of about 70 in., and a height of about 0.135 in. The overall width of the pan support structure 12 may about 67 in. Each truss arm 30 may have an overall length of about 29 in., a maximum height of about 4.9 in., and a thickness of about 0.25 in. The hub 22 may have a diameter of about 8.75 in. and also a height of about 4.9 in. The view in FIG. 3 also shows a shaft hole 23 defined through the center of the flange 24 for engaging the shaft of a rotor 14. Flange 24 may also define a series of bolt holes 25 located beyond the perimeter of the shaft hole 23 for coupling a to a mating flange of a rotor 14. A truss arm pair 30*a*-30*b* may be attached together by cross-bracing 40 and 42, in the exemplary configuration shown.

In an embodiment of a float pan not shown in the figures, a float pan may be formed along its perimeter with integral perimetric bracing. The integral perimetric bracing may be similar in form to perimetric bracing 32 shown and described herein. Alternatively, the integral perimetric bracing may be a circular (or other shaped) rim running along the upper perimeter of the float pan. Means for attaching trusses 30 to the integral perimetric bracing may be provided on the integral perimetric bracing itself, or on the distal ends of braces 30, or on both components. The structure of the attaching means should allow for convenient removal of the float pan, and may comprise slots, brackets, fasteners, cotter pins, alignments holes, or other locking or engagement devices. In any of these embodiments, the perimetric bracing 32 is absent from the float pan support structure 12.

Figure 4:
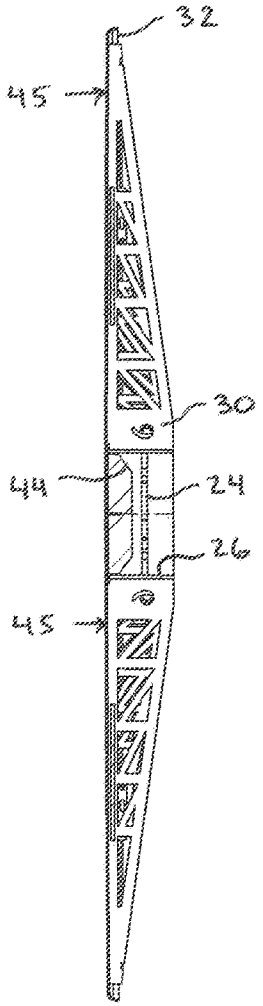
FIG. 4 is a cross sectional side view of the pan support structure of FIG. 1 taken along Section A-A.

FIG. 4 shows a cross sectional side view of the pan support structure 12. This view illustrates the shape of the inner wall 44 of truss attachment surface 26. Inner wall 44 is shaped to cooperatively engage the alignment bracket 34 of float pan 16, to aid in the alignment process described above. For example, the slope of the inner wall 44 matches the slope of the distal ends of the alignment bracket 34. This view also shows the location of pan contact surface 45.

Figure 7:
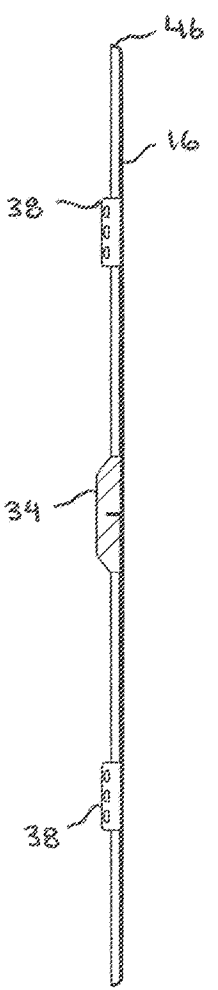
FIG. 7 is a cross sectional view of the float pan taken along section B-B of FIG. 5.
Figure 5:
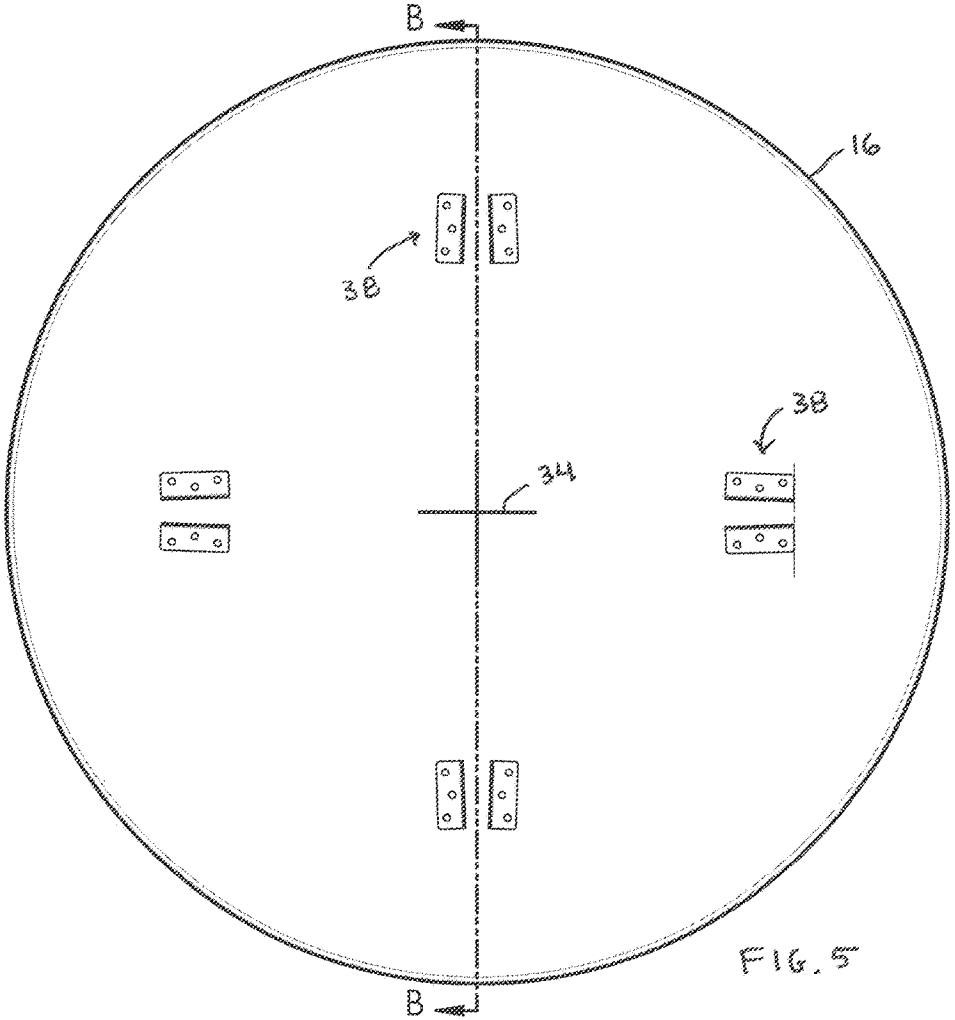
FIG. 5 is a top view of the float pan of FIG. 1.
Figure 6:
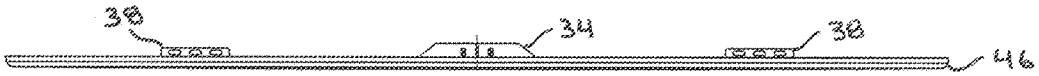
FIG. 6 is a side view of the float pan of FIG. 5.

FIG. 5 shows a top view of the float pan 16, under no load. FIG. 6 is a side view of the same float pan 16, and FIG. 7 is a cross sectional view of the same float pan taken along section B-B. These figures demonstrate a typical configuration of a float pan for use with a flotation machine of the present invention that is equipped with a pan support structure configured for conforming the shape of the float pan. Under no load, float pan 16 has substantially flat upper and lower surfaces throughout its circular area. Float pan 16 may also have a slightly upward-curving perimeter 46 all along its circumference.

FIGS. 8 to 14 illustrate various embodiments in accordance with the invention for forming a truss 30 for a float pan support structure 12. The same illustrations may describe the form of a truss arm 30*a*-30*b*. For purposes of illustration only, certain nominal dimensions are provided, and may be common to more than one embodiment. Six different embodiments of trusses are shown in FIGS. 8, 9, 10, 12, 13 and 14, and are labeled 308, 309, 310, 312, 313 and 314, respectively. It is understood that any six of these embodiments may represent a truss arm 30, 30*a*, or 30*b* as described above. Skilled artisans will also recognize that the following truss arm configurations are exemplary only, and that by varying the hole patterns, and the lengths and combinations of flat, curved, and recessed pan support surfaces, many other truss arm forms not specifically disclosed herein are possible within the scope of the invention.

Figure 8:
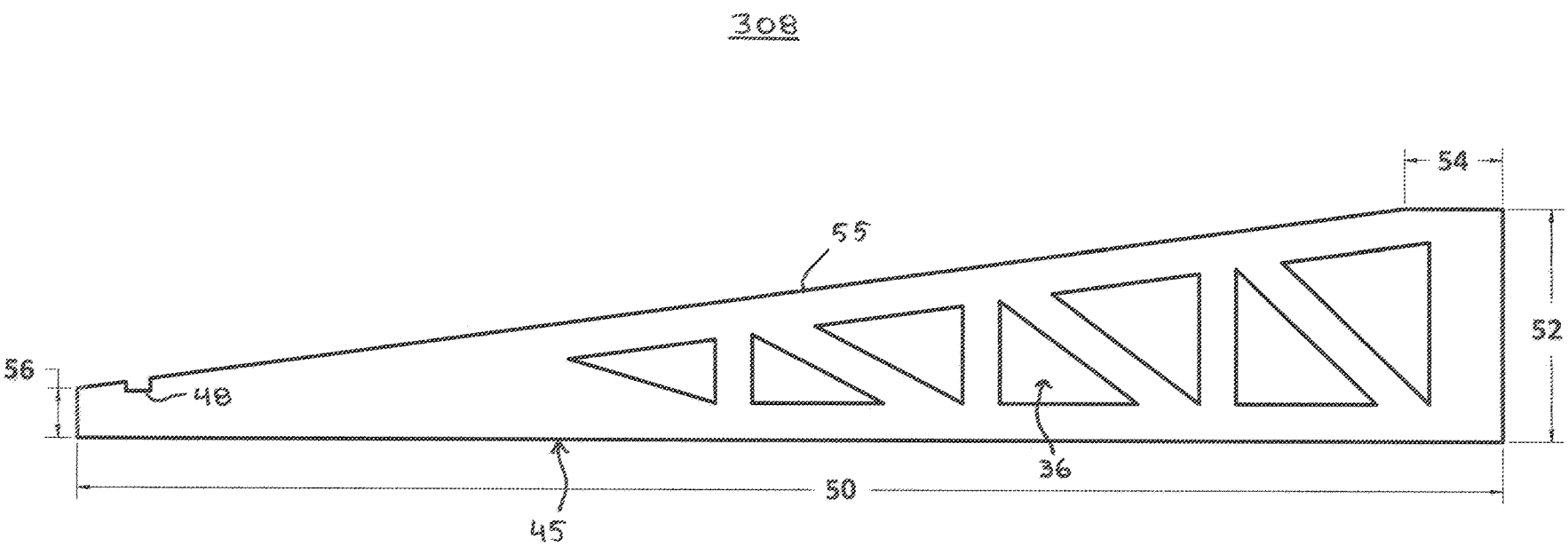
FIG. 8 is a side view of one embodiment of a truss arm for a pan support structure having a fully flat pan contact surface according to the invention.

FIG. 8, for example, shows a side view of a first embodiment of a truss arm 308. Truss arm 308 has a fully flat pan contact surface 45, which runs along the entire length of the bottom surface of the truss arm. The overall length 50 of truss arm 308 may be about 29 in. At its proximal end, the height 52 of the truss arm 308 may be about 4.75 inches. A short straight portion 54 may be formed along the top surface of truss 301, having a length of about 2 inches. A slanted length 55 runs from straight portion 54 downward to the distal end. The height 56 of truss arm 308 at the distal end may be about 1.0 in. A slot 48 may be formed near the distal end, into the top slanted surface, as shown, having a width sufficient to receive the width of a perimetric brace 32. One or more holes 36 may be defined through the truss arm 308, as shown. Holes 36 may form part of a means for rotatably attaching the float pan support structure 12 to a float pan 16. Holes 36 may be formed in a of a variety of quantities, shapes, and sizes. Advantageously, the formation of holes 36 can reduce the overall weight of a pan support structure 12 without compromising required material strength. For truss arm 308, holes 36 form vertical and 45-degree bracing to maintain truss arm strength and rigidity.

Figure 9:
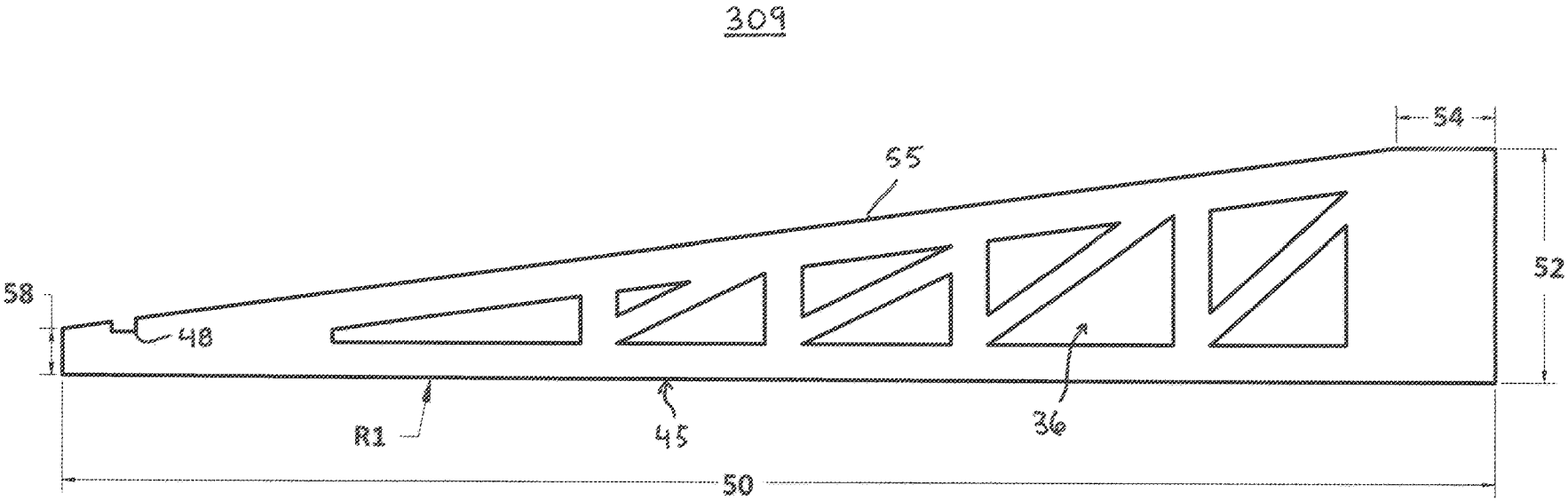
FIG. 9 is a side view of one embodiment of a truss arm for a pan support structure having a fully curved pan contact surface according to the invention.

FIG. 9 shows a side view of an embodiment of a truss arm 309 for a float pan support structure 12. Truss arm 309 is characterized by a fully curved pan contact surface 45, having a radius of curvature R1 between about 3360 in and about 6730 in. As a result of curvature R1, the height 58 of truss arm 309 at the distal end is about 0.938 inches, i.e. slightly less than height 56 of truss arm 308. In other respects, truss arm 309 if formed similarly to truss arm 308.

Figure 10:
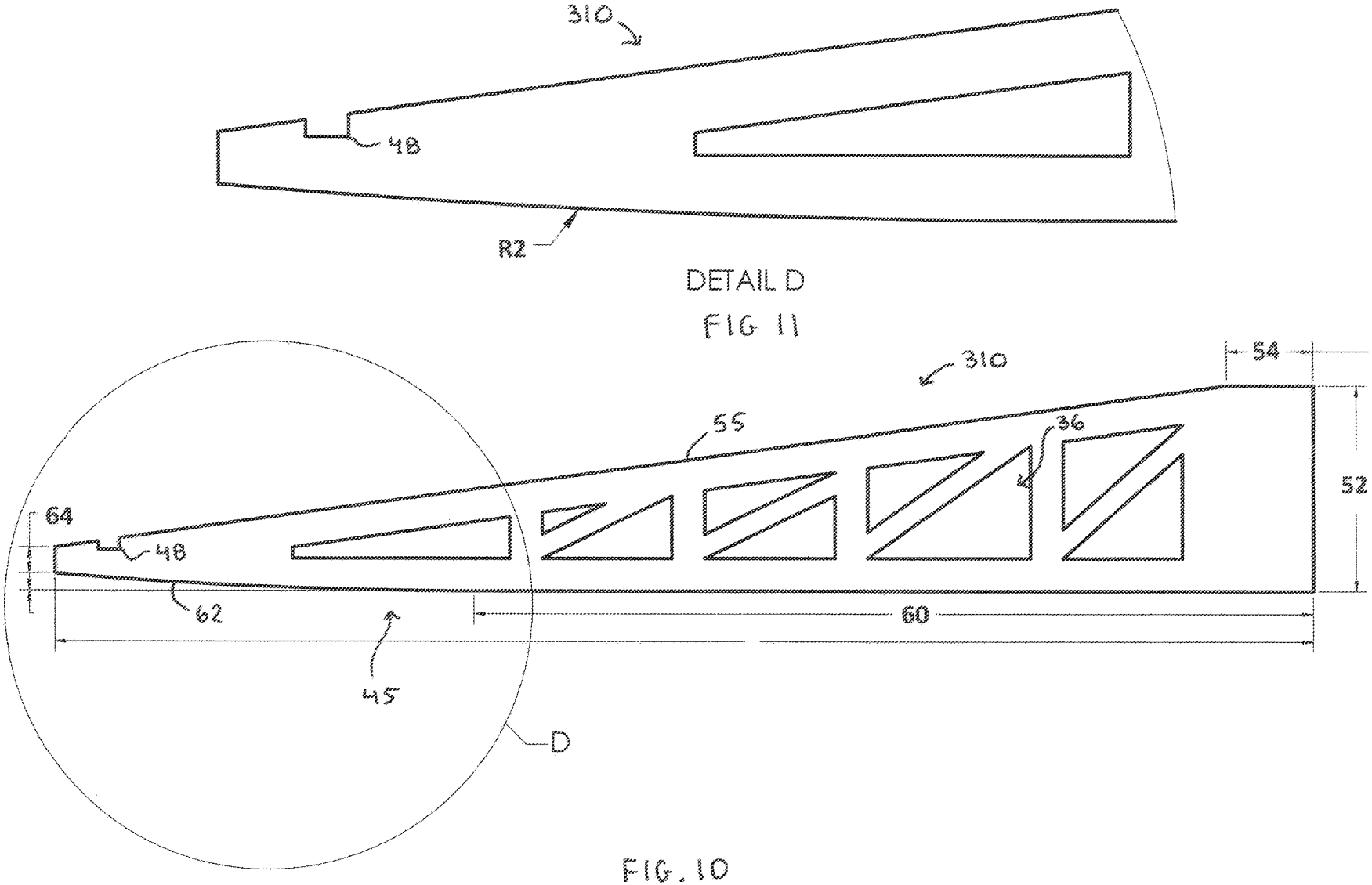
FIG. 10 is an exaggerated side view of another embodiment of a truss arm for a pan support structure having a partially flat and partially curved pan contact surface according to the invention.

FIG. 10 shows an exaggerated side view of an embodiment of a truss arm 310 for a float pan support structure 12. Solely for purposes of illustration, the curvature at the distal end of truss arm 310 is exaggerated to demonstrate an important feature of the invention in a manner that is more easily perceived by the human eye. Truss arm 310 is characterized by having a partially flat and partially curved pan contact surface 45. The length 60 of the partially flat portion may run about ⅔ of the total length of the pan contact surface, and in one embodiment may be about 20 in. The length 62 of the partially curved portion accounts for about the remaining ⅓ of the total length of the of the pan contact surface, and may have a radius of curvature R2 between about 1500 in. and about 3000 in. The height 64 of truss arm 310 at the distal end is about 0.9 inches. FIG. 11 shows a magnified side view of the distal end of truss arm 310 at detail D, to better illustrate the radius of curvature R2.

Figure 12:
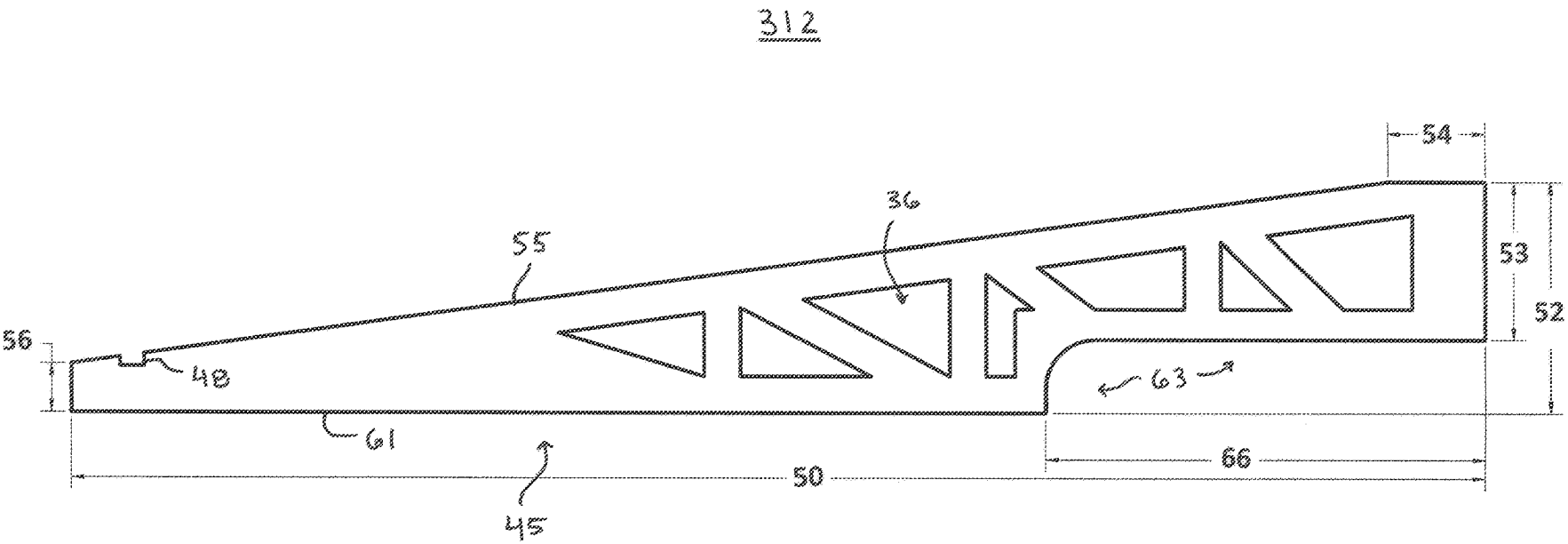
FIG. 12 is a side view of another embodiment of a truss arm for a pan support structure according to the invention having a flat pan contact surface and a recessed proximal end.

FIG. 12 shows a side view of an embodiment 312 of a truss arm for a float pan support structure 12. Truss arm 312 is characterized by a pan contact surface 45 having a flat portion 61 that runs from the distal end to about ⅔ of the total length of the truss arm. Truss arm 312 is further characterized by a recessed proximal end 63 occurring for about the remaining ⅓ of total length. The recessed proximal end 63 may facilitate removal of a float pan 16 from a surface of wet concrete. By distributing pressure away from the center of the pan, the recessed proximal end discourages creation of vacuum pressure between the center of the float pan and the surface of wet concrete, to allow for easier detachment of the float pan. In this embodiment, height 53 at the proximal end may be about 3.25 in.

Figure 13:
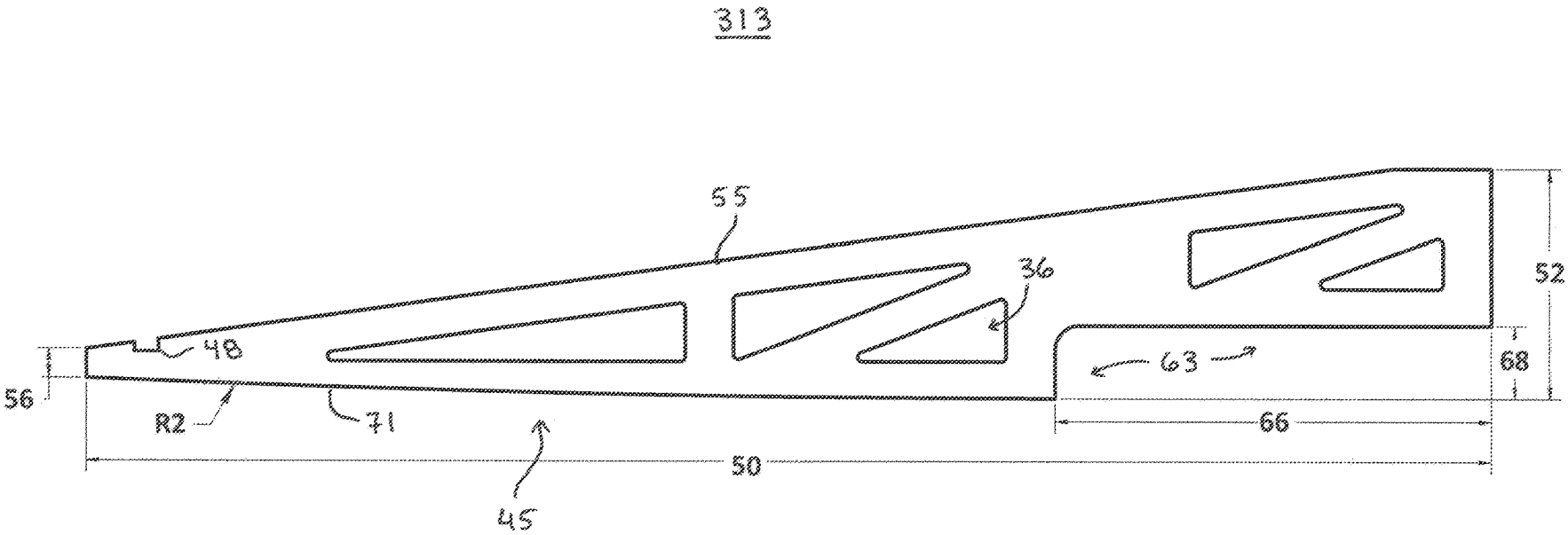
FIG. 13 is a side view of another embodiment of a truss arm for a pan support structure according to the invention having a curved pan contact surface and a recessed proximal end.

FIG. 13 shows a side view of an embodiment 313 of a truss arm for a float pan support structure 12. Truss arm 313 is characterized by a pan contact surface 45 having a curved portion 71 that runs from the distal end to about ⅔ of the total length of the truss arm. Truss arm 305 is further characterized by a recessed proximal end 63 occurring for about the remaining ⅓ of total length. The recessed proximal end 63 provides the same advantages as previously described. In this embodiment, height 68 at the proximal end may be about 1.5 in.

Figure 14:
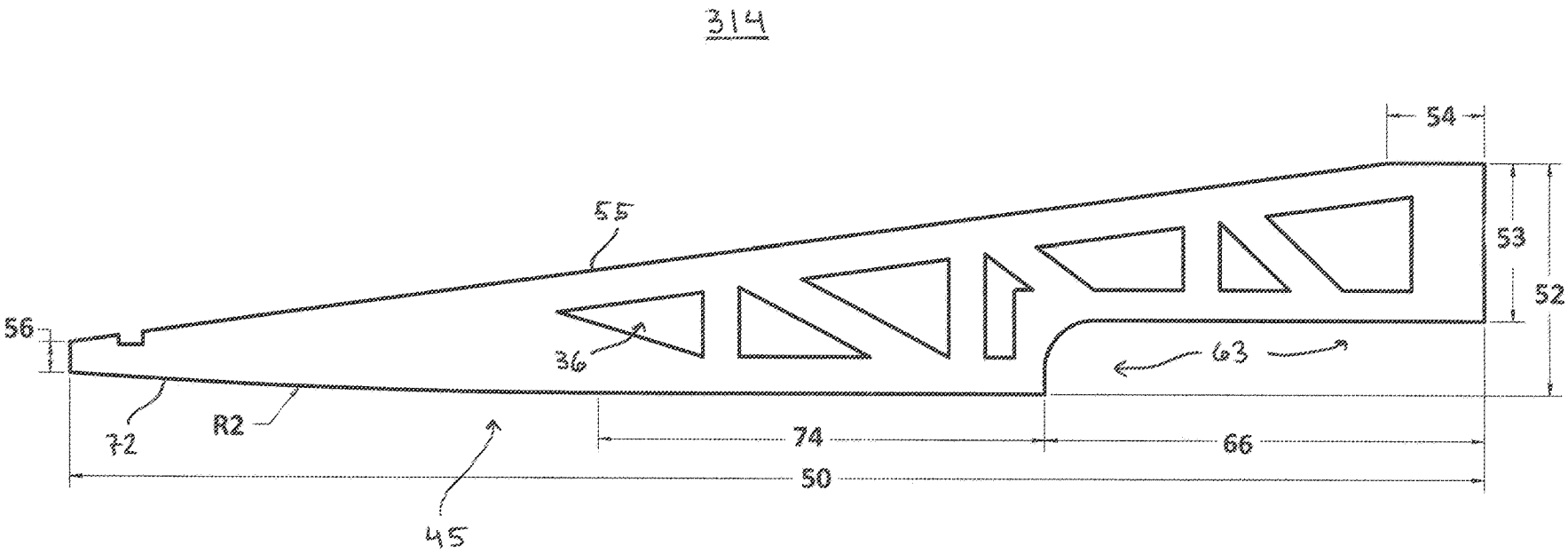
FIG. 14 is a side view of another embodiment of a truss arm for a pan support structure according to the invention having a partially flat pan and partially curved pan contact surface and a recessed proximal end.

FIG. 14 shows a side view of an embodiment of a truss arm 314 for a float pan support structure. Truss arm 314 is characterized by a pan contact surface 45 having a curved portion 72 that runs from the distal end to about ⅓ of the total length of the truss arm, and by a flat portion 74 that occupies the middle third of the overall length of the truss arm. A recessed proximal end 63 is formed for the remaining approximate ⅓ of total length. The recessed proximal end 63 provides the same advantages as previously described. In this embodiment, flat length 74 may be about 9.0 to 10 in.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A support structure for a float pan, comprising:

a hub having a rotational axis and configured for concentric attachment to a rotor;

a plurality of trusses, each truss extending radially from the hub and each truss having a float pan contact surface, wherein one or more of the trusses includes means for attachment to the float pan; and perimetric bracing linking two or more of the trusses;

wherein the hub further comprises a flange positioned concentrically with respect to the axis; and a truss attachment surface displaced radially from the axis along a perimeter of the flange, wherein the truss attachment surface circumferentially encloses the flange.

2. The support structure of claim 1 wherein the flange comprises a planar surface normal to the axis and wherein the truss attachment surface extends perpendicularly from the planar surface of the flange.

3. The support structure of claim 1 wherein the truss attachment comprises a cylinder.

4. The support structure of claim 1 wherein at least one of the trusses comprises a pair of truss arms.

5. The support structure of claim 4 wherein the truss arms of the at least one truss are connected together at a distal end of the at least one truss.

6. The support structure of claim 1 wherein the plurality of trusses are angularly spaced about the axis of the hub at regular intervals.

7. The support structure of claim 6 wherein the plurality of trusses comprises eight trusses.

8. The support structure of claim 1 wherein the float pan attachment means comprises a hole defined through the truss.

9. The support structure of claim 1 wherein the float pan contact surface of each truss has a form identical to the float pan contact surface of every other truss.

10. The support structure of claim 1 wherein the float pan contact surface of at least one truss is substantially fully flat.

11. The support structure of claim 1 wherein the float pan contact surface of at least one truss is substantially fully curved in a radial direction.

12. The support structure of claim 1 wherein the float pan contact surface of at least one truss is partially flat in a radial direction and partially curved in the radial direction.

13. The support structure of claim 1 wherein the float pan contact surface of at least one truss is substantially fully curved in a radial direction and wherein a proximal end of the at least one truss is recessed from the float pan contact surface in an axial direction.

14. The support structure of claim 1 wherein the float pan contact surface of at least one truss is partially flat in a radial direction and partially curved in the radial direction and wherein a proximal end of the al least one truss is recessed from the float pan contact surface in an axial direction.

15. The support structure of claim 1 wherein at least one of the trusses comprises a notch configured for engaging the perimetric bracing.

16. A support structure for a float pan, comprising:

a hub having a rotational axis and configured for concentric attachment to a rotor;

a plurality of trusses, each truss extending radially from the hub and each truss having a float pan contact surface, wherein one or more of the trusses includes means for attachment to the float pan; and perimetric bracing linking two or more of the trusses;

wherein the float pan contact surface of at least one truss is substantially fully flat and wherein a proximal end of the least one truss is recessed from the float pan contact surface in an axial direction.

17. A support structure for a float pan, comprising:

a hub having a rotational axis and configured for concentric attachment to a rotor;

a plurality of trusses, each truss extending radially from the hub and each truss having a float pan contact surface, wherein one or more of the trusses includes means for attachment to the float pan; and perimetric bracing linking two or more of the trusses;

wherein the hub comprises an inner wall having a slope configured to receive a centering bracket mounted on the float pan, and while receiving the centering bracket, to urge the float pan into axial alignment with the support structure.

* * * * *